US006771014B2

(12) United States Patent
Longo et al.

(10) Patent No.: US 6,771,014 B2
(45) Date of Patent: Aug. 3, 2004

(54) CATHODE DESIGN

(75) Inventors: Robert T. Longo, Arcadia, CA (US); Elmer E. Reed, Jr., Peninsula, CA (US); David W. Precht, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/949,480

(22) Filed: Sep. 7, 2001

(65) Prior Publication Data

US 2003/0048066 A1 Mar. 13, 2003

(51) Int. Cl.[7] ..... H01J 29/46

(52) U.S. Cl. ..... 313/346 DC; 313/270; 313/346 R

(58) Field of Search ..... 313/446, 346, 313/309–311, 337, 270, 346 R; 445/34, 31, 50–51

(56) References Cited

U.S. PATENT DOCUMENTS 3,636,400 A * 1/1972 Duchmann et al. ... 313/346 DC
4,302,702 A * 11/1981 Montgaillard et al. ..... 313/348
4,837,480 A * 6/1989 Breeze et al. ..... 313/346 DC
4,990,823 A * 2/1991 Swaving et al. ..... 313/446
5,013,965 A * 5/1991 Shon et al. ..... 313/446
5,208,508 A * 5/1993 Shaw ..... 313/446
5,289,076 A * 2/1994 Lee ..... 313/37
5,334,085 A * 8/1994 Shroff ..... 445/51
5,422,536 A * 6/1995 Hale et al. ..... 313/446
5,543,682 A * 8/1996 Hara et al. ..... 313/446
5,729,084 A * 3/1998 Hale et al. ..... 313/446
5,793,157 A * 8/1998 Takakura et al. ..... 313/446
6,369,494 B1 * 4/2002 Pruvost et al. ..... 313/270

* cited by examiner

*Primary Examiner*—Nimeshkumar D. Patel
*Assistant Examiner*—Dalei Dong
(74) *Attorney, Agent, or Firm*—Artz & Artz, PC

(57) ABSTRACT

A cathode system includes an impregnated pellet and a conductive cup, which has substantially cylindrical sides. The conductive cup has an open end sized to receive the impregnated pellet and a closed end. The closed end has an internal surface and an external surface. The cathode system also includes a second conductive cup. The second conductive cup also has substantially cylindrical sides, an open end and a closed end. The cathode system further includes a similar third conductive cup. The three conductive cups are electrically coupled together. For construction of the cathode, the first conductive cup receives the impregnated pellet following coupling of the three conductive cups.

7 Claims, 1 Drawing Sheet

CATHODE DESIGN

TECHNICAL FIELD

The present invention relates generally to electronic components, and, more particularly, to dispenser cathodes.

BACKGROUND ART

It is well known in the electronic field that electrodes are components of electric circuits that connect the conventional wiring of the circuits to conducting media. Examples of conducting media are metals, electrolytes or gasses.

In general, negatively charged electrodes are called cathodes, which are useful because they emit electrons. When a cathode becomes a source of electrons through a heating process, it is classified as a thermionic cathode. During cathode operation, free electrons are evaporated into the vacuum space at the cathode surface and repelled from the cathode surface because of its negative charge. These free electrons then become a useable electron flow.

Two primary types of thermionic cathodes are oxide cathodes and dispenser cathodes. Dispenser cathodes usually operate at temperatures between 900° C. to 1200° C. At these temperatures, thermal isolation of the cathode is necessary to minimize heat loss and to obtain stable electron emission. Such thermal isolation is achieved through use of refractory materials of minimum dimensions to limit thermal loss by conduction.

Impregnated dispenser cathodes are generally made from porous tungsten which is impregnated by barium compounds. When heated, the barium compounds react with the tungsten matrix. This reaction frees barium that subsequently migrates to the cathode emitter surface. Alternate variations of the porous matrix are made by mixing powders of tungsten and other refractory metals such as: iridium or osmium. Impregnated dispenser cathodes composed of these alternate variations are called mixed metal cathodes.

Impregnated cathodes characteristically have high emission current densities and long lives. They are preferred in thermoelectric tubes, such as: highly reliable microwave tubes used in satellite communication, linear accelerators, and high resolution image pickup or display tubes.

Impregnated dispenser cathodes designed for travelling wave tubes are generally supported by a complex design structure made from refractory materials. These designs require high temperature processing to affect refractory brazes and various other processes. Efficiency and life of the active element of a dispenser cathode can be compromised by these manufacturing thermal processes. More specifically, the active chemical compounds, necessary for cathode operation, can become compromised by inadvertent, but necessary, high temperature processing during the support structure construction. This inadvertent thermal processing causes chemical reactions to occur at very high rates, which subsequently reduces the efficiency and life of the cathode.

The disadvantages associated with conventional cathode construction have made it apparent that a new technique for cathode construction is needed. The new technique should substantially eliminate detrimental assembly processes. The new technique should also substantially minimize impurities on the emitter. The present invention is directed to these ends.

SUMMARY OF THE INVENTION

It is, therefore, an object of the invention to provide a construction method and design for a cathode system.

In one aspect of the invention, the cathode system includes an impregnated pellet and a first conductive cup which has first substantially cylindrical sides. The first conductive cup has a first open end sized to receive the impregnated pellet. The first conductive cup further has a first closed end. The first closed end has a first internal surface and a first external surface.

In another aspect of the invention, the cathode system includes a second conductive cup. The second conductive cup has second substantially cylindrical sides, which have a first diameter and a first length. The second conductive cup further has a second open end and a second closed end. The second closed end has a second internal surface and a second external surface, the second external surface of the second closed end of the second conductive cup electrically couples to the first external surface of the first closed end of the first conductive cup.

In still another aspect of the invention, the cathode system includes a third conductive cup. The third conductive cup also has third substantially cylindrical sides. The third substantially cylindrical sides have a second diameter less than the first diameter and a second length.

The first conductive cup receives the impregnated pellet following coupling of the first conductive cup to the second conductive cup and coupling of the second conductive cup to the third conductive cup.

The present invention thus achieves an improved cathode system and construction method. The present invention is advantageous in that it substantially eliminates residue on the emitter that usually results from the impregnating of the pellet. The present invention also facilitates cleaning of the cathode support structure without harm to the impregnated pellet.

Additional advantages and features of the present invention will become apparent from the description that follows and may be realized by the instrumentalities and combinations particularly pointed out in the appended claims, taken in conjunction with the accompanying drawings.

BRIEF DESCRIPTION OF THE DRAWINGS

For a more complete understanding of the invention, there will now be described some embodiments thereof, given by way of example, reference being made to the accompanying drawings, in which.

DETAILED DESCRIPTION

The present invention is illustrated with respect to a cathode system 10, particularly suited for the electronics field. The present invention is, however, applicable to various other uses that may require thermionic cathodes such as, but not limited to, travelling wave tubes.

Figure 1:
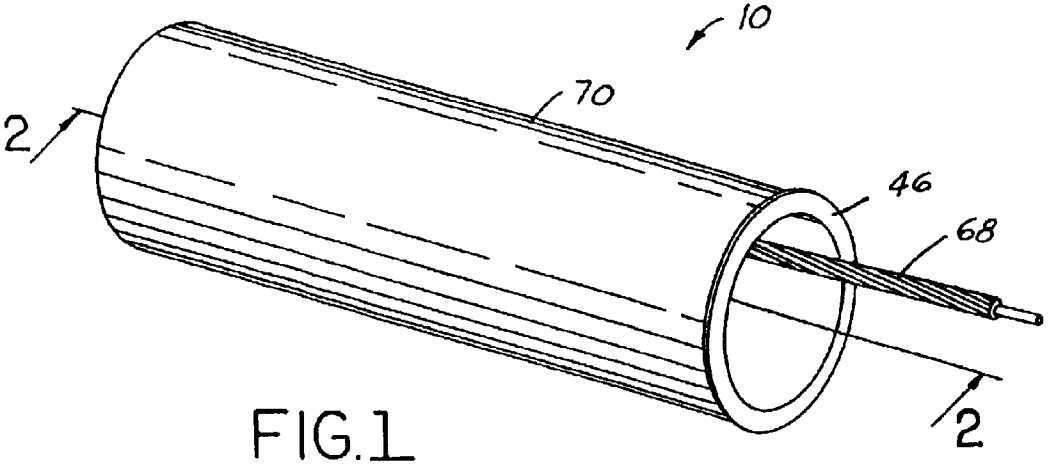
FIG. 1 is a perspective view of a cathode system in accordance with one embodiment of the present invention.
Figure 2:
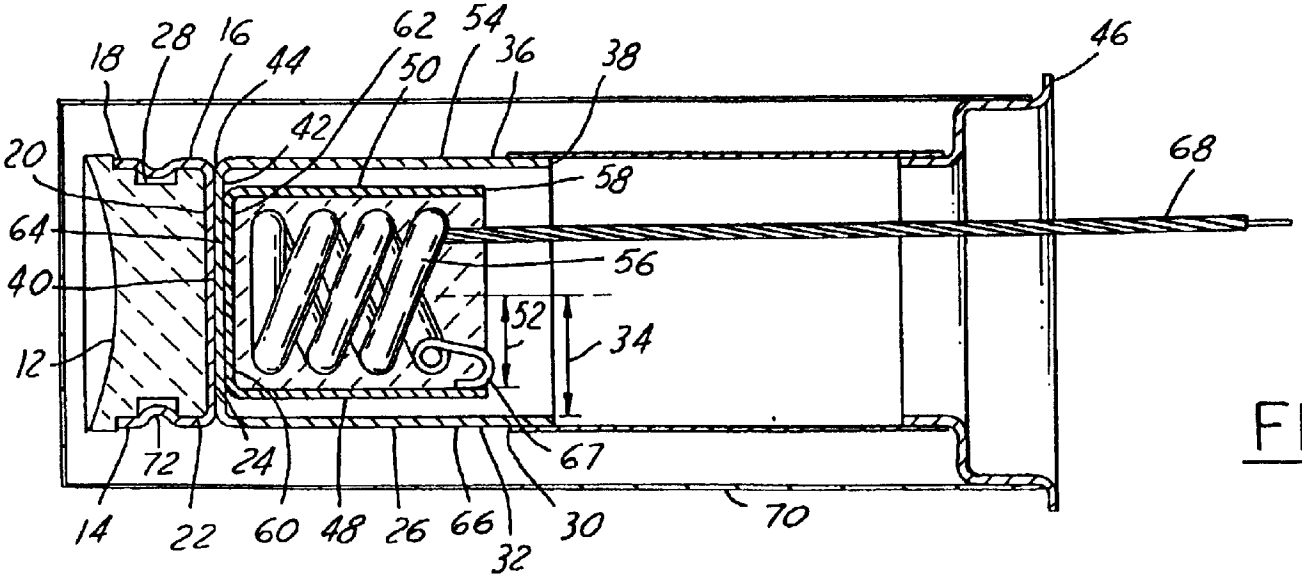
FIG. 2 is a cross-sectional view of FIG. 1 along line 2—2.

Referring to FIG. 1 and FIG. 2, a cathode system 10, in accordance with one embodiment of the present invention, is illustrated. The cathode system 10 includes an impregnated pellet 12 and a first conductive cup 14 which has first substantially cylindrical sides 16. The first conductive cup 14 has a first open end 18 sized to receive the impregnated pellet 12. The impregnated pellet 12 and the attachment thereof will be discussed later. The first conductive cup 14 further has a first closed end 20. The first closed end 20 has a first internal surface 22 and a first external surface 24. The first conductive cup 14, preferably comprises Molybdenum Rhenium (MoRe). MoRe was chosen because it is relatively strong, highly conductive and anti-corrosive thus making it ideal for cathode support structure 26 construction, as will be understood by one skilled in the art.

The impregnated pellet 12 is composed of chemical compounds typical of active cathode elements. Important to the present invention, however, is that the impregnated pellet 12 is fabricated prior to reception into the first conductive cup 14. The impregnated pellet 12, illustrated in FIG. 2, has a groove 28 which facilitates the securing of the impregnated pellet 12 to the first conductive cup 14, as will be discussed later.

The cathode system 10 also includes a second conductive cup 30, which preferably comprises Molybdenum Rhenium (MoRe). The second conductive cup 30 has second substantially cylindrical sides 32, which have a first diameter 34 and a first length 36. The second conductive cup 30 further has a second open end 38 and a second closed end 40. The second closed end 40 has a second internal surface 42 and a second external surface 44, the second external surface 44 of the second closed end 40 of the second conductive cup 30 electrically couples to the first external surface 24 of the first closed end 20 of the first conductive cup 14. Ideally, the two conductive cups 14, 30 will be electrically coupled through a brazing process, as will be understood by one skilled in the art. An electron emitter 46 electrically couples to the second open end of the second conductive cup 30.

The cathode system 10 further includes a third conductive cup 48, which also preferably comprises Molybdenum Rhenium (MoRn). The third conductive cup 48 also has third substantially cylindrical sides 50. The third substantially cylindrical sides 50 have a second diameter 52 less than the first diameter 34 and a second length 54. Though the first length 36 and the second length 54 need not be different, the current embodiment includes a second length 54 which is substantially less than the first length 36. The first length 36 is larger here because the third conductive cup 48 is essentially a housing for a cathode heater 56, which will be discussed later. The longer length substantially prevents contact from the cathode heater 56 to the conductive media the cathode will operate within, as will be understood by one skilled in the art. The third conductive cup 48 has an open end 58 and a closed end 60, the closed end 60 has a third internal surface 62 and a third external surface 64. The third external surface 64 of the third closed end 60 of the third conductive cup 48 is electrically coupled to the second internal surface 42 of the second closed end 40 of the second conductive cup 30. Ideally, the two conductive cups 30, 48 will be electrically coupled through a brazing process, as will be understood by one skilled in the art.

The third conductive cup 48 receives and couples to the cathode heater 56. The cathode heater 56, illustrated in FIG. 2, is typical of cathode heater design. Potting materials 66 hold the cathode heater 56 in place and the contact 67 electrically connects the cathode heater 56 to the third conductive cup 48. The current embodiment includes a conductive rod 68 extending from the potted cathode heater 56 and away from the conductive cups 14, 30, 48. When electrically engaged, the conductive rod 68 supplies energy to the cathode heater 56 for operation, as will be understood by one skilled in the art.

FIG. 1 illustrates a substantially insulated external casing 70, which surrounds the sides of the first, second and third conductive cups 14, 30, 48. The external casing 70 protects and substantially insulates cathode components, as will be understood by one skilled in the art.

Figure 3:
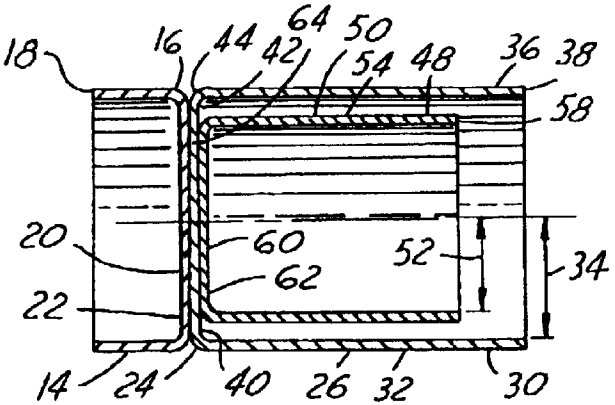
FIG. 3 is a component view of the cathode support structure shown in FIG. 2 prior to construction of the cathode system, in accordance with one embodiment of the present invention.

Referring to FIG. 3, a component view of the cathode support structure 26, shown in FIG. 2 prior to construction of the cathode system 10, in accordance with one embodiment of the present invention, is illustrated. The cathode support structure 26 is composed of the first second and third conductive cups 14, 30, 48 discussed earlier with reference to FIG. 1 and FIG. 2. In FIG. 3, however, the first substantially cylindrical sides 16 of the first conductive cup 14 are illustrated in form prior to reception and attachment of the impregnated pellet 12, which will be discussed later.

During construction of the cathode system 10, the first closed end 20 of the first conductive cup 14 electrically couples to the second closed end 40 of the second conductive cup 30 such that the open end 18 of the first conductive cup 14 and the open end 38 of the second conductive cup 30 open in substantially opposite directions. The second closed end 40 of the second conductive cup 30 is also electrically coupled to the third closed end 60 of the third conductive cup 48 such that the second open end 38 of the second conductive cup 30 and the third open end 58 of the third conductive cup 48 open in substantially the same direction. As was previously mentioned, the conductive cups 14, 30, 48 are brazed together. Brazing is a typical process used to electrically couple structures composed of MoRe, as will be understood by one skilled in the art.

Subsequently, the cathode heater 56 couples to the third conductive cup 48. In the present embodiment, this coupling is accomplished by a contact 67 connected between the cathode heater 56 and the third conductive cup 48. Next, potting materials 66 are added to the third conductive cup 48 to hold the cathode heater 56 in place, as will be understood by one skilled in the art. This completes the cathode support structure 26. The cathode support structure 26 may now be brought to a high level of purity through high-temperature heating. This high-temperature heating facilitates reduction of impurities and oxidation, as will be understood by one skilled in the art. Previously, the support structure 26 would be high-temperature heated with the impregnated pellet 12 already inserted. This arrangement introduces the impregnated pellet 12 to potentially harmful temperatures. The present invention avoids this potential harm to the efficiency and operability of the impregnated pellet 12.

Prior to insertion into the first conductive cup 14 of the support structure 26, a cathode pellet is impregnated to form the impregnated pellet 12, as will be understood by one skilled in the art. Constructing the impregnated pellet 12 prior to insertion into the support structure 26 creates the opportunity to impregnate the pellet 12 from the side of the impregnated pellet 12 that faces the closed end of the first conductive cup 14. Pellets are typically impregnate after they are secured to the emitter surface 46. This creates the potential for residue to deposit on the emitter surface 46, as will be understood by one skilled in the art. The novel method provided in the present invention avoids the potential residue hazard.

The impregnated pellet 12 is then inserted into the first conductive cup 14 such that it contacts the first internal surface 22 of the first conductive cup 14. The first conductive cup 14 is then crimped around the impregnated pellet 12. In the present embodiment, a heated memory-metal crimping device constricts around the first conductive cup 14. The device used for the present invention ideally uses Titanium Nickel (TiNi), a heat shrinkable memory metal, surrounding a multi-section mandrel. The multi-section mandrel includes solid members contacting the first conductive cup 14 in the area of the groove 28. When heated, the TiNi compresses the mandrel around the first conductive cup 14. This crimps the first conductive cup 14 around the impregnated pellet. The groove 28 receives the crimped portion 72 of the first conductive cup 14, which avoids unnecessary deforming of the impregnated pellet 12 through the compression of the crimping process. Of course, the crimping process could include any known crimping process. In addition, more than one groove can be formed in the pellet 12 to receive the crimped sidewall of the first conductive cup 14. The groove can also be in the shape of a notch, as shown in FIG. 2 or rounded to conform to the crimp or a v shape.

In another embodiment, relief tabs can be formed into the sidewall of the first conductive cup 14 in the area of the groove. The tabs can be bent inward, into the groove, to secure the pellet 12 within the cup 14. Similar mechanical connections are contemplated by the present invention.

In operation, heat from the cathode heater 56 conducts through the first second and third conductive cups 14, 30, 48 and activates the impregnated pellet 12 such that negatively charged ions travel through the first and second conductive cups 14, 30 charging the emitter 46 with the negatively charged ions.

From the foregoing, it can be seen that there has been brought to the art a new and improved cathode system 10. It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims:

What is claimed is:

1. A cathode system comprising: an impregnated pellet; and a first conductive cup having a first cylindrical edge, said first conductive cup having a first open end adapted to receive said impregnated pellet, said first conductive cup further having a first closed end, said first closed end having a first internal surface and a first external surface; wherein said impregnated pellet includes a groove which facilitates securing said impregnated pellet to said first conductive cup, and wherein said first conductive cup is crimped around said impregnated pellet in an area of said groove.

2. The cathode system as recited in claim 1 further including a second conductive cup having a second cylindrical edge, said second cylindrical edge having a first diameter and a first length, said second conductive cup having a second open end and a second closed end, said second closed end having a second internal surface and a second external surface, said second external surface of said second closed end of said second conductive cup electrically coupled to said first external surface of said first closed end of said first conductive cup.

3. The cathode system as recited in claim 2 further including a third conductive cup having a third cylindrical edge, said third cylindrical edge having a second diameter less than said first diameter and a second length, said third conductive cup further having a third open end and a third closed end, said third closed end having a third internal surface and a third external surface, said third external surface of said third closed end of said third conductive cup electrically coupled to said second internal surface of said second closed end of said second conductive cup.

4. The cathode system as recited in claim 3 wherein a heating element is coupled to said third conductive cup.

5. The cathode system as recited in claim 3 wherein said second length of said third cylindrical edge of said third conductive cup is less than said first length of said second cylindrical edge of said second conductive cup.

6. A cathode comprising: an impregnated pellet; a first conductive cup having a first cylindrical edge, said first conductive cup having a first open end sized to receive said impregnated pellet, said first conductive cup further having a first closed end, said first closed end having a first internal surface and a first external surface, a second conductive cup having a second cylindrical edge, said second cylindrical edge having a first diameter and a first length, said second conductive cup having a second open end and a second closed end, said second closed end having a second internal surface and a second external surface, said second external surface of said second closed end of said second conductive cup electrically coupled to said first external surface of said first closed end of said first conductive cup; an electron emitter electrically coupled to said second open end of said second conductive cup; a third conductive cup having a third cylindrical edge, said third cylindrical edge having a second diameter less than said first diameter and a second length, said third conductive cup further having a third open end and a third closed end, said third closed end having a third internal surface and a third external surface, said third external surface of said third closed end of said third conductive cup electrically coupled to said second internal surface of said second closed end of said second conductive cup; a cathode heater received in and electrically coupled to said third conductive cup; and an insulted external casing surrounding said first, second and third conductive cup; wherein said impregnated pellet is mechanically engaged within said first conductive cup wherein said first conductive cup is crimped around said impregnated pellet in an area of said groove, which facilitates securing said impregnated pellet to said first conductive cup.

7. The cathode system as recited in claim 6 wherein said second length of said third cylindrical edge of said third conductive cup is less than said first length of said second cylindrical edge of said second conductive cup.

* * * * *